US010327619B2

(12) United States Patent
Moser et al.

(10) Patent No.: US 10,327,619 B2
(45) Date of Patent: Jun. 25, 2019

(54) SURFACE CLEANING MACHINE

(71) Applicant: Alfred Kärcher GmbH & Co. KG, Winnenden (DE)

(72) Inventors: Fabian Moser, Schorndorf (DE); Manuel Schulze, Kornwestheim (DE); Johanna Buchmann, Stuttgart (DE); Christoph Rufenach, Korntal-Muenchingen (DE); Andreas Mueller, Oppenweiler (DE); Alexander Braendle, Gundelsheim (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 106 days.

(21) Appl. No.: 15/485,897

(22) Filed: Apr. 12, 2017

(65) Prior Publication Data

US 2017/0215681 A1 Aug. 3, 2017

Related U.S. Application Data

(63) Continuation of application No. PCT/EP2015/073315, filed on Oct. 8, 2015.

(30) Foreign Application Priority Data

Oct. 13, 2014 (DE) ..... 10 2014 114 776

(51) Int. Cl.
*A47L 11/40* (2006.01)
*A47L 11/24* (2006.01)
(Continued)

(52) U.S. Cl.
CPC ..... *A47L 11/4041* (2013.01); *A47L 9/0411* (2013.01); *A47L 11/202* (2013.01); *A47L 11/24* (2013.01); *A47L 11/302* (2013.01); *A47L 11/4008* (2013.01); *A47L 11/4016* (2013.01); *A47L 11/4027* (2013.01); *A47L 11/4044* (2013.01); *A47L 11/4069* (2013.01);
(Continued)

(58) Field of Classification Search
CPC ..... A47L 11/4041; A47L 11/4083; A47L 11/4069; A47L 11/4088; A47L 11/4044; A47L 11/4027; A47L 11/4075; A47L 11/4008; A47L 11/302; A47L 11/4016; A47L 11/24; A47L 11/202; A47L 9/0411
IPC ..... A47L 11/40
See application file for complete search history.

(56) References Cited

U.S. PATENT DOCUMENTS 1,436,420 A 11/1922 Weydell
4,136,420 A 1/1979 Cyphert et al.
(Continued)

FOREIGN PATENT DOCUMENTS

CA 2 411 936 11/2003
CH 607 578 9/1978
(Continued)

*Primary Examiner* — David Redding
(74) *Attorney, Agent, or Firm* — Womble Bond Dickinson (US) LLP

(57) ABSTRACT

A surface cleaning machine is provided, including a cleaning roller holder, a cleaning roller that is arranged on the cleaning roller holder, a drive device for rotary driving of the cleaning roller, and a sweeping element that is associated with the cleaning roller and supplies swept material to the cleaning roller, wherein the sweeping element is arranged rotatably on the cleaning roller holder.

32 Claims, 11 Drawing Sheets

(51) Int. Cl.
*A47L 11/30* (2006.01)
*A47L 9/04* (2006.01)
*A47L 11/202* (2006.01)

(52) U.S. Cl.
CPC ..... *A47L 11/4075* (2013.01); *A47L 11/4083* (2013.01); *A47L 11/4088* (2013.01)

(56) References Cited

U.S. PATENT DOCUMENTS

| | | | | |
|---|---|---|---|---|
| 4,173,054 | A | 11/1979 | Ando | |
| 4,668,256 | A | 5/1987 | Billiet et al. | |
| 5,086,539 | A | 2/1992 | Rench | |
| 5,350,432 | A | 9/1994 | Lee | |
| 5,657,504 | A | 8/1997 | Khoury | |
| 6,026,529 | A | 2/2000 | Caruso | |
| 6,400,048 | B1 | 6/2002 | Nishimura et al. | |
| 6,475,256 | B2 | 11/2002 | Matsubara et al. | |
| 6,662,402 | B2 | 12/2003 | Giddings et al. | |
| 6,735,812 | B2 | 5/2004 | Hekman et al. | |
| 7,128,770 | B2 | 10/2006 | Oh et al. | |
| 7,150,068 | B1 | 12/2006 | Ragner | |
| 7,272,870 | B2 | 9/2007 | Pierce et al. | |
| 7,341,611 | B2 | 3/2008 | Greene et al. | |
| 7,559,963 | B2 | 7/2009 | Oh et al. | |
| 7,665,174 | B2 | 2/2010 | Basham et al. | |
| 7,921,497 | B2 | 4/2011 | Cook et al. | |
| 7,967,914 | B2 | 6/2011 | Giddings et al. | |
| 7,979,952 | B2 | 7/2011 | Beskow et al. | |
| 8,016,996 | B2 | 9/2011 | Field et al. | |
| 8,025,786 | B2 | 9/2011 | Field et al. | |
| 8,230,549 | B2 | 7/2012 | Lenkiewicz et al. | |
| 9,289,105 | B2 | 3/2016 | Moes | |
| 9,999,332 | B2 * | 6/2018 | Braendle ..... | A47L 11/204 |
| 2002/0194692 | A1 | 12/2002 | Giddings et al. | |
| 2003/0159232 | A1 | 8/2003 | Hekman et al. | |
| 2005/0160553 | A1 | 7/2005 | Gregory | |
| 2005/0262659 | A1 | 12/2005 | Roschi et al. | |
| 2009/0089967 | A1 | 4/2009 | Yang et al. | |
| 2009/0119871 | A1 | 5/2009 | Dilger et al. | |
| 2010/0132150 | A1 | 6/2010 | Egler et al. | |
| 2010/0236010 | A1 | 9/2010 | Johnson | |
| 2012/0066861 | A1 | 3/2012 | Louis et al. | |
| 2012/0222244 | A1 | 9/2012 | Conrad | |
| 2013/0091663 | A1 | 4/2013 | Mersmann | |
| 2013/0219641 | A1 | 8/2013 | Guijarro | |
| 2014/0000060 | A1 | 1/2014 | Demirtas et al. | |
| 2014/0150984 | A1 | 6/2014 | Nishikawa et al. | |
| 2014/0182079 | A1 | 7/2014 | Van Der Kooi et al. | |
| 2015/0082579 | A1 | 3/2015 | Lin | |
| 2016/0270613 | A1 | 9/2016 | Demirtas et al. | |
| 2016/0278597 | A1 | 9/2016 | Braendle et al. | |
| 2017/0215676 | A1 | 8/2017 | Moser et al. | |
| 2017/0215677 | A1 | 8/2017 | Moser et al. | |
| 2017/0215678 | A1 | 8/2017 | Moser et al. | |
| 2017/0215679 | A1 | 8/2017 | Moser et al. | |
| 2018/0228331 | A1 | 8/2018 | Moser et al. | |

FOREIGN PATENT DOCUMENTS

| | | |
|---|---|---|
| CN | 2109165 | 7/1992 |
| CN | 2174947 | 8/1994 |
| CN | 2266377 | 11/1997 |
| CN | 2675734 | 2/2005 |
| CN | 1718149 | 1/2006 |
| CN | 2845698 Y | 12/2006 |
| CN | 201158807 | 12/2008 |
| CN | 201384462 | 1/2010 |
| CN | 201930938 | 8/2011 |
| CN | 202151938 | 2/2012 |
| CN | 102493381 | 6/2012 |
| CN | 202313126 | 7/2012 |
| CN | 203346836 | 12/2013 |
| CN | 103690112 | 4/2014 |
| DE | 294 642 | 10/1991 |
| DE | 41 17 957 | 12/1992 |
| DE | 102 42 257 | 4/2003 |
| DE | 10 2004 013 262 | 9/2005 |
| DE | 10 2007 031 371 | 1/2009 |
| DE | 10 2008 013 485 | 11/2009 |
| EP | 0 012 337 | 6/1980 |
| EP | 0 186 005 | 7/1986 |
| EP | 0 844 843 | 7/2002 |
| EP | 1 535 560 | 1/2005 |
| EP | 1 465 518 | 4/2005 |
| EP | 1 736 089 | 12/2006 |
| EP | 1994868 | 11/2008 |
| EP | 2 177 128 | 4/2010 |
| EP | 2 387 932 | 11/2011 |
| EP | 2 641 524 | 9/2013 |
| EP | 2 721 988 | 4/2014 |
| FR | 2 797 895 | 3/2001 |
| GB | 1123052 | 8/1968 |
| GB | 2 341 124 | 3/2000 |
| GB | 2 411 823 | 9/2005 |
| GB | 2 420 967 | 6/2006 |
| GB | 2 435 820 | 9/2007 |
| JP | 2000342495 | 12/2000 |
| JP | 2001037695 | 2/2001 |
| JP | 2005-211350 | 8/2005 |
| JP | 2013081829 | 5/2013 |
| WO | WO 84/04663 | 12/1984 |
| WO | WO 90/14787 | 12/1990 |
| WO | WO 97/06721 | 2/1997 |
| WO | WO 00/78198 | 12/2000 |
| WO | WO 01/037716 | 5/2001 |
| WO | WO 02/28251 | 4/2002 |
| WO | WO 02/069775 | 9/2002 |
| WO | WO 2005/089614 | 9/2005 |
| WO | WO 2005/096907 | 10/2005 |
| WO | WO 2006/102147 | 9/2006 |
| WO | WO 2006/110459 | 10/2006 |
| WO | WO 2010/041185 | 4/2010 |
| WO | WO 2010/140967 | 12/2010 |
| WO | WO 2013/027140 | 2/2013 |
| WO | WO 2013/027164 | 2/2013 |
| WO | WO 2013/106762 | 7/2013 |

* cited by examiner

SURFACE CLEANING MACHINE

CROSS-REFERENCE TO RELATED APPLICATIONS

This application is a continuation of international application number PCT/EP2015/073315 filed on Oct. 8, 2015 and claims the benefit of German application number 10 2014 114 776.6 filed on Oct. 13, 2014, which are incorporated herein by reference in their entirety and for all purposes.

BACKGROUND OF THE INVENTION

The invention relates to a surface cleaning machine, comprising a cleaning roller holder, a cleaning roller that is arranged on the cleaning roller holder, a drive device for rotary driving of the cleaning roller, and a sweeping element that is associated with the cleaning roller and supplies swept material to the cleaning roller.

WO 2013/027140 A1 or US 2014/0182079 A1 discloses a cleaning device for cleaning a surface that includes a rotatable brush. Further provided is a rubber wiping element that is at a spacing from the brush and is secured to an underside of a nozzle housing.

WO 2013/027164 A1 also discloses a cleaning device having a rotatable brush and a single rubber wiping element.

EP 2 177 128 A1 discloses a device for distributing fluid on a brush.

DE 41 17 157 A1 discloses a method for cleaning or swabbing a preferably smooth surface, in which the surface to be cleaned is wiped off with a substantially cloth-like wiping element, during which dirt is taken up by the wiping element, and then the dirty wiping element is moistened and thereafter the dirt is removed from the wiping element by suction.

WO 2010/140967 A1 discloses a method for cleaning a dirty surface.

CH 607 578 discloses a brush device that is connectable to a water line.

EP 0 186 005 A1 discloses a brush suction nozzle that is provided with wheels.

FR 2 797 895 discloses a brush.

US 2002/0194692 A1 discloses a method for mechanically removing dirt from a surface.

DE 102 42 257 B4 discloses a floor dust collecting device that has an electric motor drive, a dust collecting container, a covering lid and a brush. As it is rotated, the brush throws dust particles in a particular direction, wherein, associated with the brush, there is provided a ramp that is arranged oriented in relation to the direction in which dust is thrown and is deflectable in the direction in which dust is thrown.

EP 1 465 518 B1 discloses a surface cleaning device that includes a substantially continuous surface cleaning strip that extends over an underside of a housing.

SUMMARY OF THE INVENTION

In accordance with the present invention, a surface cleaning machine is provided, by means of which optimum cleaning results are produced on a surface to be cleaned and in particular a hard surface to be cleaned.

In accordance with an embodiment of the invention, the sweeping element is arranged rotatably on the cleaning roller holder.

As a result of the rotatable arrangement, the sweeping element is movable in relation to the cleaning roller holder and hence also to the cleaning roller. It is thus possible to achieve a constant spacing between the rotating cleaning roller and the sweeping element, regardless of an angular position of the surface cleaning machine in relation to the surface to be cleaned, when the cleaning roller is placed on the surface to be cleaned. The rotatable movability of the sweeping element enables a corresponding adaptability.

The sweeping element serves to sweep up coarse dirt, which can then be carried along by the rotating cleaning roller. The fact that the sweeping element is movable by way of rotatability on the cleaning roller holder makes possible a constant spacing between a contact line of the at least one cleaning roller and a contact line of the sweeping element, with a surface to be cleaned. Consequently, it enables the angle to be variable in respect of a longitudinal direction of the surface cleaning machine in relation to the surface to be cleaned. In this way, for example cleaning under furniture and similar can also be achieved. Optimized cleaning results are produced, with a comprehensive range of possible operating modes.

The rotatability of the sweeping element is independent of the rotation of the at least one cleaning roller. With reference to this rotation, the sweeping element is positioned non-rotatably on the cleaning roller holder.

The length of an arc between a surface to be cleaned and an opening in a suction duct at the surface to be cleaned can be bridged in variable manner as a result of the movability of the sweeping element. Even if the cleaning roller and the sweeping element are the only points of contact with the surface to be cleaned, coarse dirt can be swept up in all angular positions (within an operating range) of the surface cleaning machine with the aid of the rotating cleaning roller, with no centrifugal effect.

As a result of the arrangement of the sweeping element such that it can move rotatably on the cleaning roller holder, good resistance to wear can be achieved with the possibility of a structurally advantageous construction.

It is particularly favorable if an axis of rotation of the sweeping element is oriented at least approximately parallel to, and in particular coaxial with, an axis of rotation of the cleaning roller. This produces optimized guidance of the sweeping element. Angular offsets from a precisely parallel arrangement, of for example up to 20° or up to 10°, can occur as a result of an uneven thickness of the sweeping element.

It is most particularly favorable if a resilient device is provided that acts with a spring force on the sweeping element, wherein in particular the spring force presses the sweeping element and hence a sweeping edge against a surface to be cleaned when the cleaning roller is placed on the surface to be cleaned. This produces an optimized sweeping result and an optimized effect of carrying along coarse dirt (with no centrifugal effect) by the rotating cleaning roller. Coarse dirt is carried along regardless of the angular position of the surface cleaning machine in relation to the surface to be cleaned. The resilient device provides a restoring force such that there is a substantially constant spacing between a contact line of the rotating cleaning roller and a contact line of the sweeping element, in any angular position of the surface cleaning machine in relation to the surface to be cleaned. This in turn produces an optimized cleaning result.

In one embodiment, the resilient device is dimensioned such that the sweeping element is rotatably movable in opposition to the spring force as a result of the force of the weight of the surface cleaning machine. The force of the weight of the surface cleaning machine then allows the sweeping element to be relocated in dependence for example on an angular position of the surface cleaning machine. In this way, the possibility of a simple structural construction of the surface cleaning machine is produced.

Advantageously, the resilient device is dimensioned such that the sweeping element is not pushed under the at least one cleaning roller by the action of the spring force. As a result, the possibility that the at least one cleaning roller will be raised by the sweeping element is avoided.

Advantageously, the resilient device is supported on the sweeping element and the cleaning roller holder, or a device connected to the cleaning roller holder, and is in particular articulated thereto. This allows a required restoring force to be achieved by the resilient device.

The resilient device has for example at least one helical spring or torsion spring or rubber spring or pneumatic spring in order to provide an appropriate spring force.

In one embodiment, the resilient device includes at least a first spring and a second spring which are spaced from one another, wherein the drive device is at least partly located between the first spring and the second spring. With an arrangement of this kind, the resilient device is integrated into the surface cleaning machine in a structurally simple manner. It produces optimized utilization of space. Moreover, the symmetrical arrangement allows an even application of force by the sweeping element to be achieved.

In particular, a direction of rotation of the sweeping element in opposition to the spring force is clockwise, and in particular a direction of rotation of the sweeping element when it moved by the spring force is counterclockwise. With a structurally simple construction, optimized cleaning results are produced.

It is most particularly advantageous if there is provided a suction device, having a suction unit and at least one suction nozzle which is fluidically connected to the suction unit and is directed towards the cleaning roller for the removal of fluid at the cleaning roller by suction. The cleaning roller allows dirt to be carried along, and this dirt is then removed by suction through the suction device.

In particular, in a cleaning mode, the sweeping element is located between a surface to be cleaned, towards which the cleaning roller is directed, and the at least one suction nozzle. As a result, coarse dirt may also be carried along and removed by suction.

In particular, the surface cleaning machine is of a type in which, in a cleaning mode, it is placed or supported on a surface to be cleaned solely by way of the cleaning roller. This allows good cleaning results to be produced with a simple structural arrangement. In particular, the corresponding surface cleaning machine can be of a weight-saving and space-saving construction. This produces good maneuverability; consequently, even areas that are otherwise difficult to access can be cleaned by machine.

For example, the sweeping edge is arranged to be movably rotatable on the cleaning roller holder such that, in any angular position relative to the surface to be cleaned within an operating range of the surface cleaning machine, a spacing between the sweeping element and the cleaning roller, and in particular a spacing between the sweeping element and a contact region of the cleaning roller on the surface to be cleaned, is at least approximately constant. The result is that coarse dirt is carried along in a constant manner and optimized cleaning results are produced.

In one exemplary embodiment, in the cleaning mode with the surface cleaning machine being pushed forwards, a direction of rotation of the cleaning roller is clockwise. This produces an optimized dirt detaching effect.

For example, an angular range for the rotatability of the sweeping element on the cleaning roller holder comprises at least 20° and in particular at least 30° and in particular at least 40° in relation to a starting position (zero degree position), wherein in the starting position the sweeping element is deflected, by way of a sweeping edge, to a minimal extent in relation to the cleaning roller holder, that is to say projects to a minimal extent beyond the cleaning roller holder. The starting position is defined for example by abutment against a barrier element.

It is favorable if the sweeping element has a sliding region for sliding on the cleaning roller holder. This produces a structurally favorable guidance on the cleaning roller holder.

In that case, it is favorable if the sliding region takes the form of a cylinder shell or part of a cylinder shell, in order in particular to be able to provide a circular guidance.

For the same reason, it is favorable if the cleaning roller holder has an inside that faces the cleaning roller and on which the sliding region of the sweeping element is slidable.

It may be provided in this case for the sliding region to have a rigid construction and in this case to be of a sufficiently rigid construction for normally occurring dirt not to buckle the sliding region.

As an alternative, it may be provided for the sliding region to be of a sufficiently flexible construction for it to be bucklable away from the cleaning roller as a result of accumulations of dirt. In that case, coarse dirt can accumulate there. Once the sweeping element has undergone a rotational movement, this coarse dirt can be carried along by the rotating cleaning roller. The rotational movement is in turn brought about by a change in the angular position of the surface cleaning machine in relation to the surface to be cleaned.

It is further favorable if the sweeping element has a region for abutment (abutment lip) and in particular a resilient region for abutment against a surface to be cleaned that is arranged in particular on a sliding region of the sweeping element. This produces an optimized sweeping function for collecting coarse dirt, wherein this coarse dirt may in turn then be carried along by the rotating cleaning roller and removed by suction.

It is favorable if there is arranged on the cleaning roller holder a first guide device and on the sweeping element a second guide device that cooperates with the first guide device for the purpose of rotatable guidance of the sweeping element on the cleaning roller holder. This produces, in a structurally simple manner, a movable arrangement of the sweeping element on the cleaning roller holder. In particular, guidance of the sweeping element on a circular track may be achieved in a simple manner.

For example, the second guide device has guide elements that are arranged on end sides of the sweeping element and cooperate with counter-guiding elements of the first guide device that are arranged on end sides of the cleaning roller holder, wherein the first guide device and/or the second guide device provides a guide track. A corresponding guidance may be produced in a structurally simple manner. For example, an abutment for defining a starting position may be integrated into a guide of this kind in a simple manner.

In a structurally advantageous embodiment, the sweeping element is guided on a circular track on the cleaning roller holder. For the purpose of variability of the sweeping element, which ensures a gap that is as constant as possible between the cleaning roller and the sweeping element, the sweeping element as a whole is arranged movably on the cleaning roller holder.

In particular when the surface cleaning machine having a cleaning roller placed on a surface to be cleaned is pushed in a forward direction, the sweeping element is remote from the forward direction and covers the cleaning roller to the rear and lies on the surface to be cleaned at least over a length of the cleaning roller. This produces an optimized sweeping function. In particular, there is a gap between the sweeping element and the cleaning roller. This gap is dimensioned such that coarse dirt that accumulates at the sweeping element can be correspondingly carried along by the rotating cleaning roller.

It is further favorable if a wetting device is provided for the cleaning roller. This allows the rotating cleaning roller to be moistened. In this way, dirt on the surface to be cleaned can be detached and carried along better.

The description below of preferred embodiments serves, together with the drawings, to explain the invention in more detail.

DETAILED DESCRIPTION OF THE INVENTION

Figure 1:
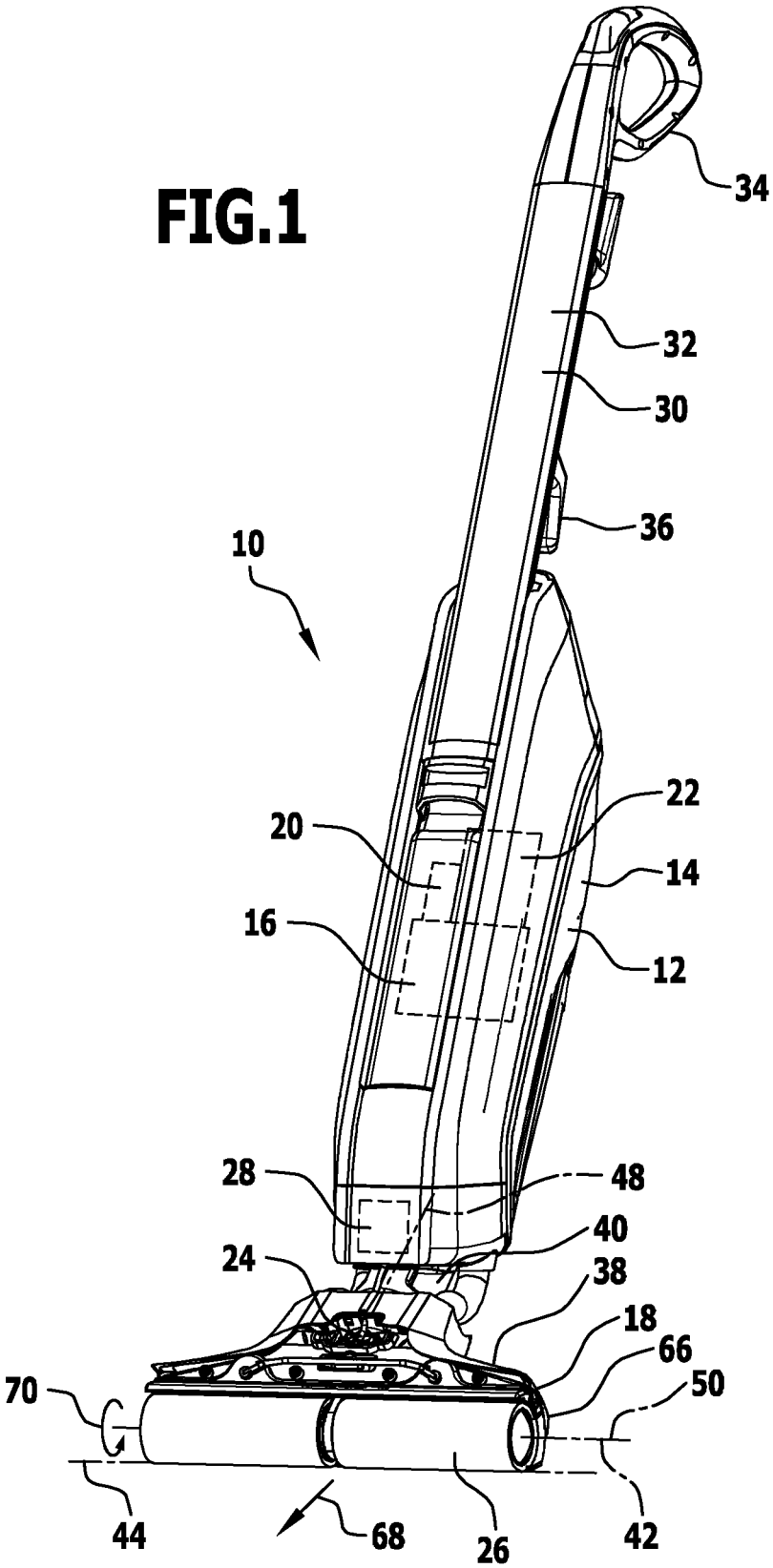
FIG. 1 shows a perspective illustration of an exemplary embodiment of a surface cleaning machine.

An exemplary embodiment of a surface cleaning machine according to the invention that is shown in FIG. 1 serves for cleaning (hard) floors. It is thus a floor cleaning machine. The floor surface cleaning machine 10 includes a device body 12 having a housing 14. Arranged protected in the housing 14 are components of the floor surface cleaning machine 10.

In an exemplary embodiment, there is arranged in the housing 14 a suction unit 16 that includes a fan device and a motor device (in particular an electric motor device) for driving the fan device. By way of the suction unit 16, a suction stream is generated in order to bring about removal by suction at a cleaning head 18.

Further arranged in the housing 14 is a separating device 20 that separates off from one another solid and liquid components in a suction stream.

Further arranged in the housing 14 is a reservoir device 22 for dirty liquid (drawn in by suction). The reservoir device 22 is in particular removably located on the housing 14.

The surface cleaning machine 10 includes a wetting device 24 by way of which a cleaning roller 26 of the cleaning head 18 can be supplied with cleaning liquid (water, or water with an additional detergent). Arranged in the housing 14 is a reservoir device 28 for cleaning liquid that provides the wetting device 24 with this cleaning liquid.

The surface cleaning machine 10 is hand-held. A holder 30 is arranged on the device body 12. This holder 30 includes a holding rod 32, on the end region whereof a handle 34 is seated. The handle 34 in particular takes the form of a stirrup-shaped handle. Operating elements, and in particular a switch for switching on and off corresponding devices of the surface cleaning machine 10, are arranged in the region of the handle 34.

A winding device 36 for a mains cable may be arranged on the holding rod 32.

The cleaning head 18 is located on the device body 12 at an end remote from the handle 34. It is for example arranged to be pivotal on the device body 12.

The cleaning head 18 includes a cleaning roller holder 38 on which the cleaning roller 26 is seated.

Associated with the cleaning roller 26 is a drive device 40 that includes in particular a drive motor. The drive device 40 is arranged in the housing 14 or in the cleaning head 18.

In one exemplary embodiment, part of the drive device 40 is arranged in the housing 14 and part is arranged on the cleaning head 18.

The drive device 40 in particular includes an electric motor. The latter provides a torque for the purpose of driving the cleaning roller 26 in rotation about an axis of rotation 42.

In one mode of the surface cleaning machine 10, the latter is placed on the surface to be cleaned by way of the cleaning roller 26 and is supported thereon solely by the cleaning roller 26. A person operating the surface cleaning machine 10 holds it by the handle 34, wherein in normal operation the person is standing. The person operating the surface cleaning machine 10 can adjust an angular position thereof (an angular position of the holding rod 32) in relation to the surface to be cleaned. This is done by way of the angular positioning of the whole device 10 in relation to the surface to be cleaned.

Figure 9B:
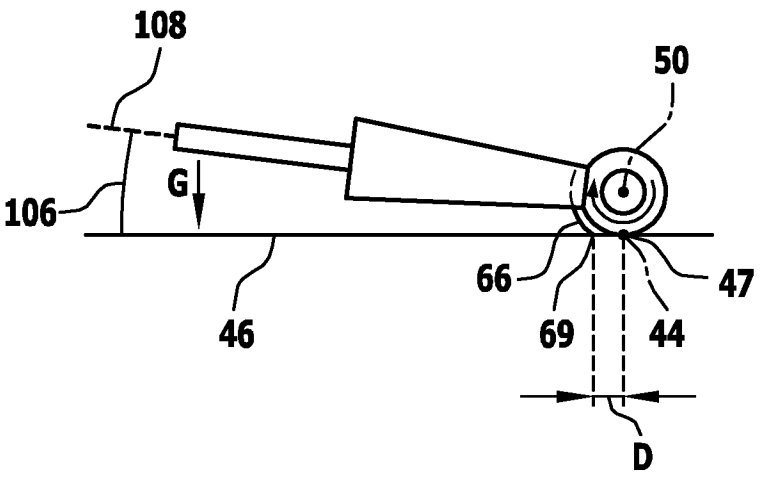
FIGS. 9(*a*), (*b*) show different angular positions of the surface cleaning machine in relation to a surface to be cleaned, with different rotary positions of a sweeping element.
Figure 9A:
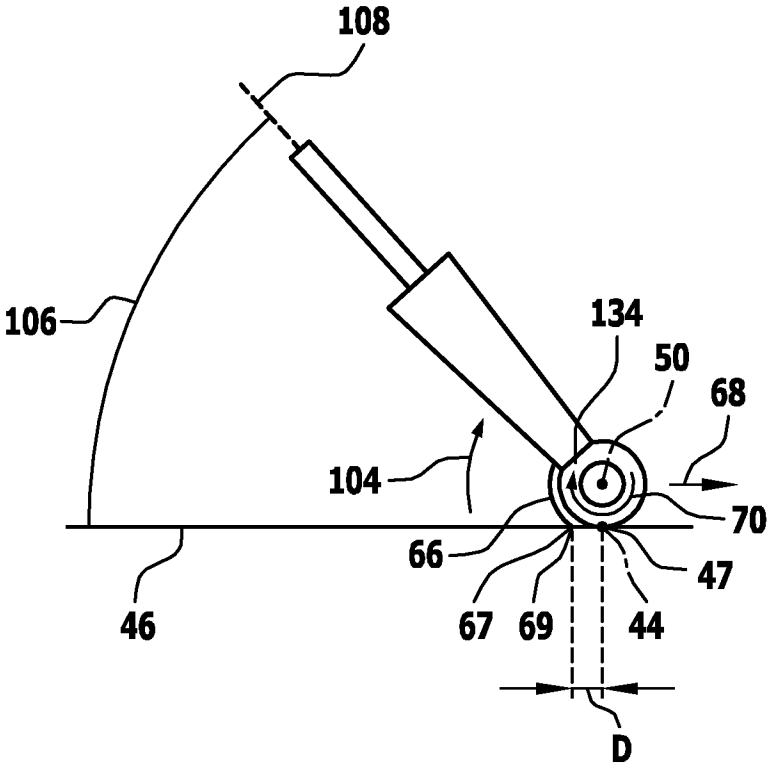

A pivot axis 44 for an angular movement of this kind (compare also FIGS. 9(*a*) and 9(*b*)) is formed by the region for abutment of the cleaning roller 26 against a surface 46 to be cleaned.

A pivot axis 48 for the possibility of pivoting by the cleaning head 18 in relation to the device body 12 lies transversely to this pivot axis 44 or transversely to the axis of rotation 42.

The cleaning roller 26 has a longitudinal axis 50. This longitudinal axis 50 is coaxial with the axis of rotation 42. In a cleaning mode of the surface cleaning machine 10, the longitudinal axis 50 lies coaxially with the surface 46 to be cleaned. The pivot axis 44 for pivoting of the whole device 10 in relation to the surface 46 to be cleaned is at least approximately parallel to this longitudinal axis 50.

Figure 2:
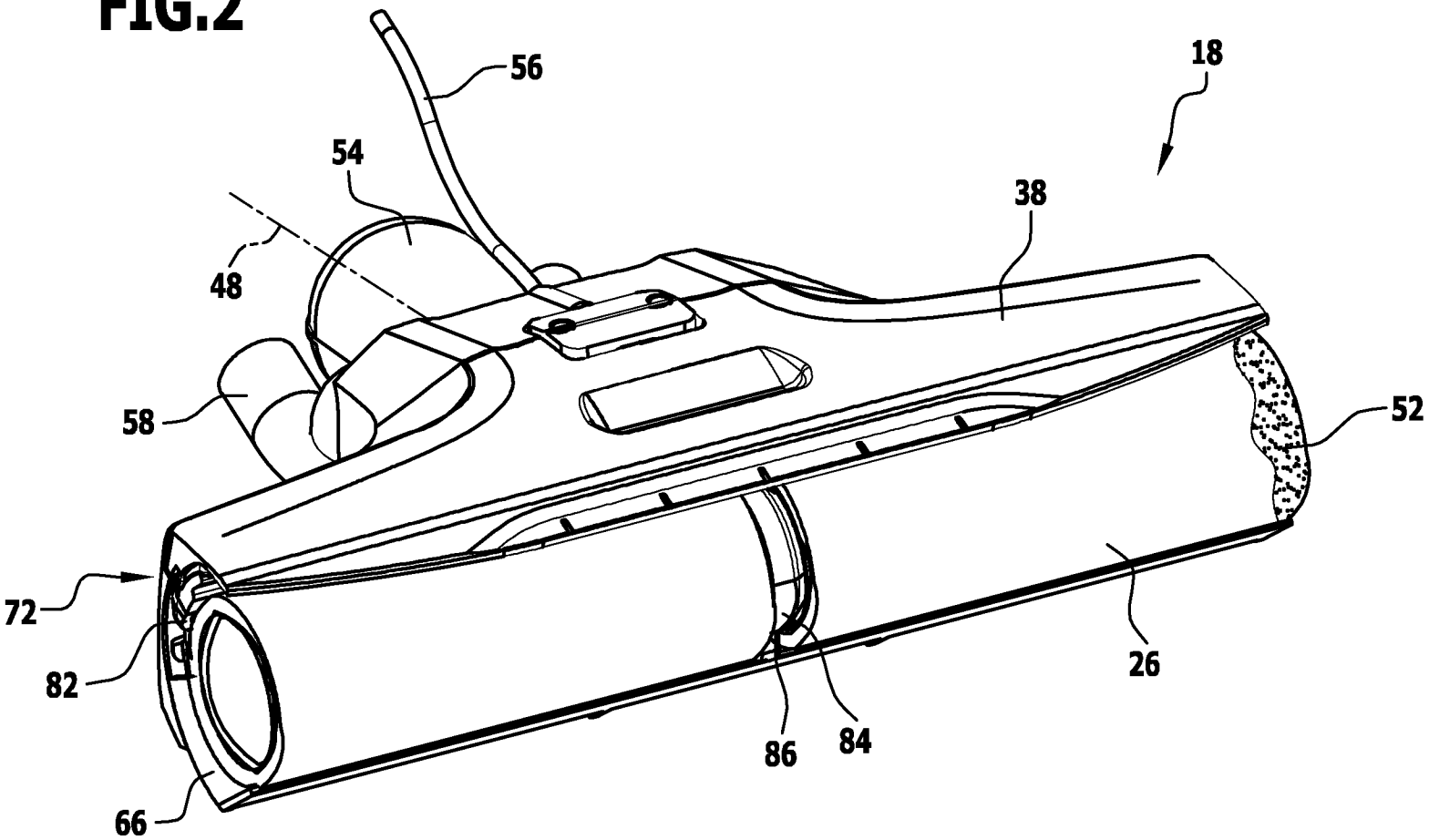
FIG. 2 shows a perspective illustration of a roller region of the surface cleaning machine in FIG. 1.
Figure 3:
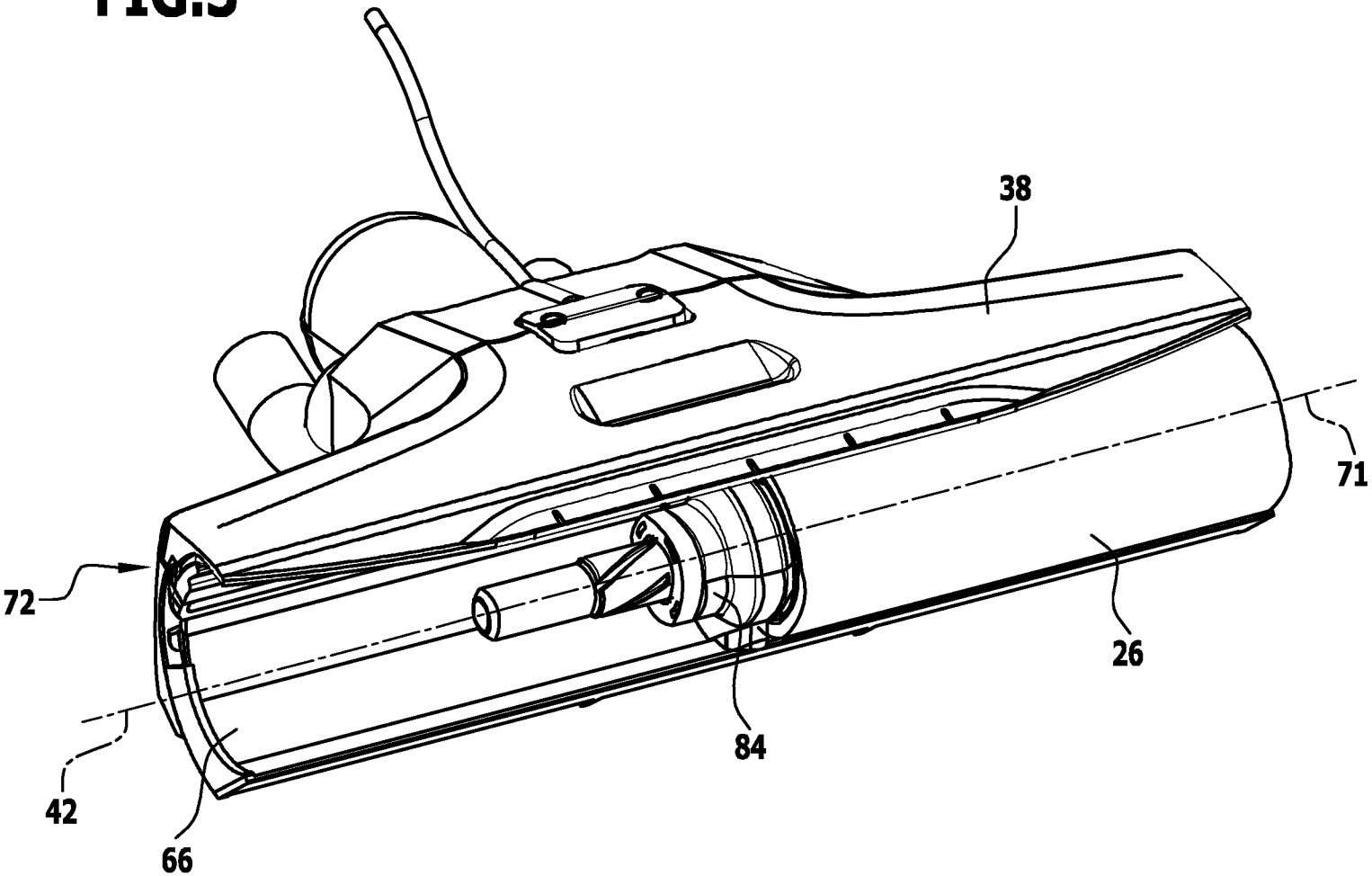
FIG. 3 shows a partial illustration of the roller region in FIG. 2.
Figure 4:
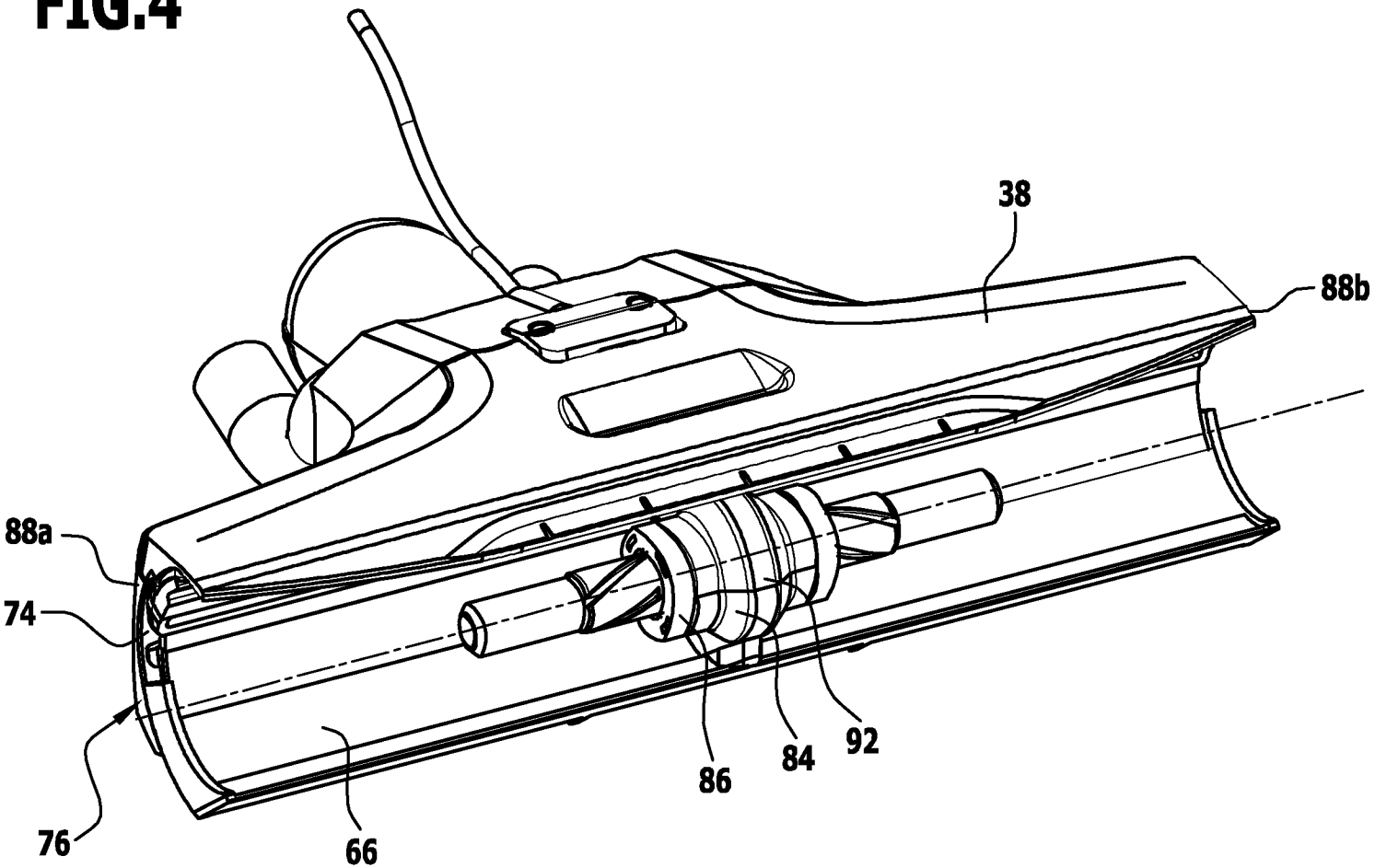
FIG. 4 shows a further partial illustration of the roller region in FIG. 2.

As indicated in FIG. 2 by the reference numeral 52, the cleaning roller 26 is provided with a jacket.

The cleaning head 18 (compare also FIGS. 3 to 8) having the cleaning roller holder 38 is provided for an in particular detachable connection to the device body 12. It includes a connection piece 54 that is arranged on the cleaning roller holder 38 and by way of which the cleaning head 38 is pivotally mounted on the device body 12.

One or more liquid lines 56 lead from the wetting device 24, which is arranged in particular on the housing 14, to the wetting device 24 of the cleaning head 18. Arranged on the cleaning roller holder 38 are nozzles by way of which cleaning liquid may be applied to the cleaning roller 26.

For operation of the surface cleaning machine 10, it is provided in particular for cleaning liquid not to be applied directly to the surface 46 to be cleaned but for the cleaning roller 26 to be moistened by means of its jacket 52 and then for the moistened cleaning roller 26 to be applied to the surface 46 to be cleaned.

Further, one or more connectors 58 for a suction stream are provided on the cleaning head 18, in this case on the cleaning roller holder 38. A connector 58 of this kind is fluidically connected to the suction unit 16 by way of one or more suction lines.

There is arranged on the cleaning roller holder (at least) one suction nozzle 60 (compare FIG. 7) that is directed towards the cleaning roller 26. The suction nozzle 60 is fluidically connected to the connector 58 and hence to the suction unit 16. A stream having a negative pressure acts on the suction nozzle 60. This stream removes dirt by suction.

In one exemplary embodiment, when the cleaning roller 26 is placed on the surface 46 to be cleaned, the suction nozzle 60 is arranged above the cleaning roller 26 in relation to the surface 46 to be cleaned.

In one exemplary embodiment, the suction nozzle 60 has a first nozzle wall 62 and a second nozzle wall 64. Formed between these is the suction nozzle 60, with a corresponding nozzle opening. The first nozzle wall 62 lies above the second nozzle wall 64. The first nozzle wall 62 and/or the second nozzle wall 64 abut against the jacket 52 of the cleaning roller 26 or in particular project into it. This embodiment is described in the international patent application PCT/EP2013/076445, dated 12 Dec. 2013, of the same Applicant, which is not a prior publication. Reference is made to the content of that document in its entirety.

The cleaning head 18 has a sweeping element 66 that is associated with the cleaning roller 26.

In a ("normal") cleaning mode, for example the surface cleaning machine 10 is pushed forwards in a forward direction 68 (compare FIG. 1). The cleaning roller 26 rotates in a clockwise direction 70. A region of the cleaning roller 26 is moistened by the wetting device 24 before it makes contact with the surface 46 to be cleaned. This region then rotates towards the surface 46 to be cleaned. Dirt is loosened. By rotating the cleaning roller 26 on the surface 46 to be cleaned, dirt is carried along and supplied to the suction nozzle 60. Removal by suction can take place there.

Coarse dirt which was for example not carried along directly by the cleaning roller 26 can be "collected" by the sweeping element 66 and then carried along by way of the cleaning roller 26.

The sweeping element 66 is arranged on the cleaning roller holder 38. The sweeping element 66 is transported in a translational movement as a result of being fixed to the cleaning roller holder 38. The sweeping element 66 is mechanically uncoupled from rotation of the cleaning roller 26.

In a cleaning mode, the sweeping element 66 covers a rear side of the cleaning head 18, wherein the rear side lies behind the cleaning roller 26, in the opposite direction to the forward direction 68. The sweeping element 66 extends at least and in particular substantially exactly over the length of the cleaning roller 26 along the longitudinal axis 50. In normal operation, the sweeping element 66 abuts against the surface 46 to be cleaned.

In a normal operation, the sweeping element 66 is located between the surface 46 to be cleaned and the suction nozzle 60.

The sweeping element 66 is held rotatably on the cleaning roller holder 38. An axis of rotation 71 (compare for example FIG. 3) for rotatability of the sweeping element 66 on the cleaning roller holder 38 is parallel to, and in particular coaxial with, the axis of rotation 42 about which the cleaning roller 26 rotates.

The sweeping element 66 is in particular guided on a circular track.

For this purpose, the cleaning roller holder 38 is provided with a first guide device 72 for the sweeping element 66. The first guide device 72 (FIGS. 2 to 6) is arranged on an inside 74 of the cleaning roller holder 38 that faces the cleaning roller 26.

The sweeping element 66 is provided with a second guide device 76 that cooperates with the first guide device 72 of the cleaning roller holder 38, for guiding the sweeping element 66 on a circular track on the cleaning roller holder 38.

The second guide device 76 (FIG. 5) has guide elements 78*a*, 78*b* arranged on end sides of the sweeping element 66. The guide elements 78*a*, 78*b* each have an insertion region 80, for example in a dovetail shape.

The first guide device 72 has, associated with the guide elements 78*a*, 78*b*, guide tracks 82 that are in each case on end sides of the cleaning roller holder 38 and into which the respective insertion region 80 penetrates. This therefore produces a forced guidance (on a circular track) of the sweeping element 66 on the cleaning roller holder 38.

The drive device 40 includes a transmission 84. This in turn includes a partial region 86 (FIGS. 2 to 4) that is arranged on the cleaning roller holder 38, facing the inside 74. This region 86 is in this case arranged centrally between opposite end sides 88*a*, 88*b* of the cleaning roller holder 38.

The cleaning roller 26 is for example made in two parts and is seated on, and driven by way of, the region 86.

A separator 90 is seated on the cleaning roller holder 38, on the inside 74 and centrally between the end sides 88*a*, 88*b*. This separator 90 serves to separate dirt and dirty fluid to left and right.

The sweeping element 66 includes a sliding region 94. This sliding region 94 takes the form for example of a cylinder shell or part of a cylinder shell. The sliding region 94 is for example made from a metal material and for example from a metal sheet.

The sliding region 94 abuts against the inside 74 of the cleaning roller holder 38 and, when the sweeping element 66 is moved in rotation, slides thereon.

A region 96 for abutment is seated on the sliding region 94 of the sweeping element 66. The region 96 for abutment forms an abutment lip against the surface 46 to be cleaned. The region 96 for abutment is made from a resilient material and in particular rubber material, in order to achieve an abutment that may be well adapted to the surface 46 to be cleaned.

In principle, the sliding region 94 may be made with a rigidity such that in normal mode there is no flexible deformation.

In an alternative embodiment, the sliding region 94 is made sufficiently flexible for buckling of the cleaning roller 26 away downwards (in opposition to the forward direction 68) to be possible. Buckling of this kind may result from an accumulation of dirt and may in some circumstances enhance the cleaning action.

Figure 5:
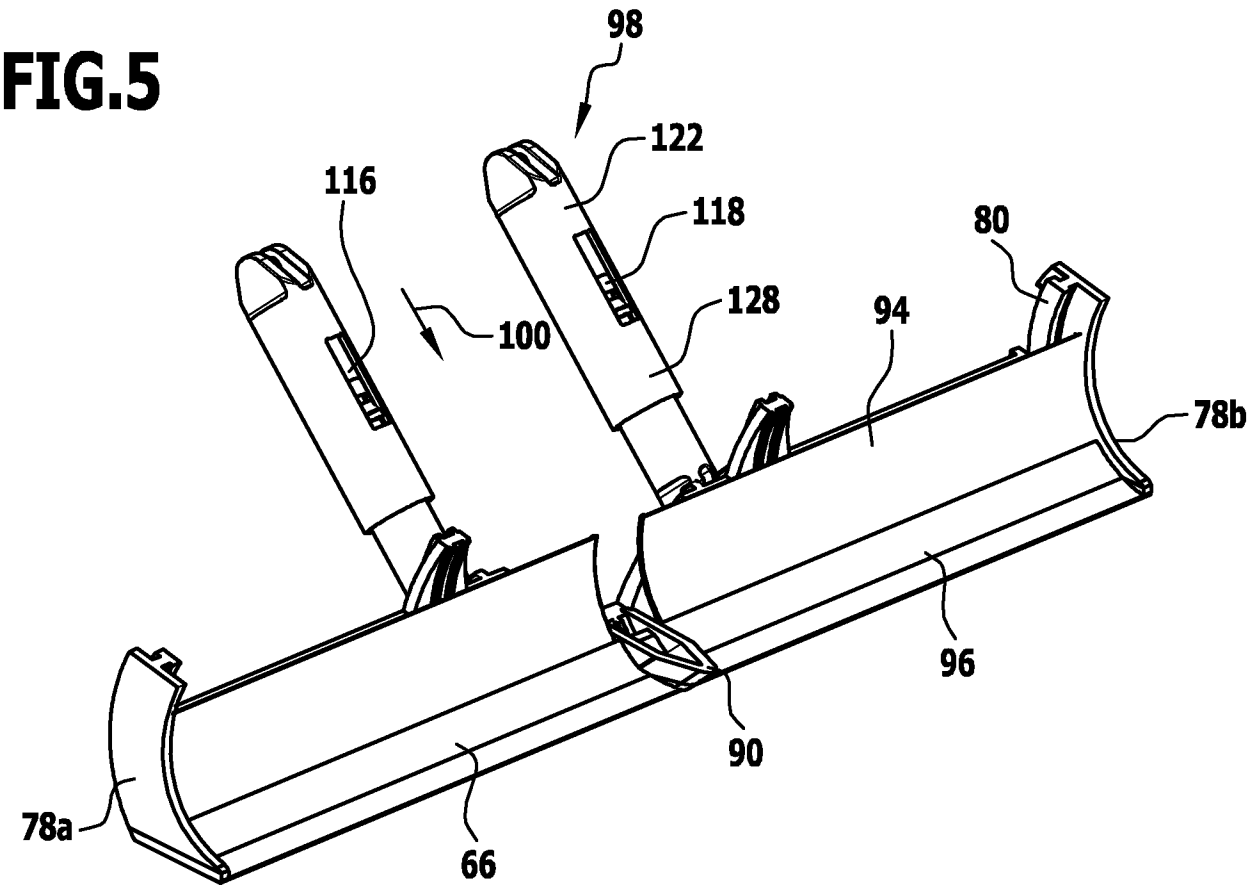
FIG. 5 shows a perspective view of an exemplary embodiment of a sweeping element that is arranged on the roller region in FIG. 2.
Figure 6:
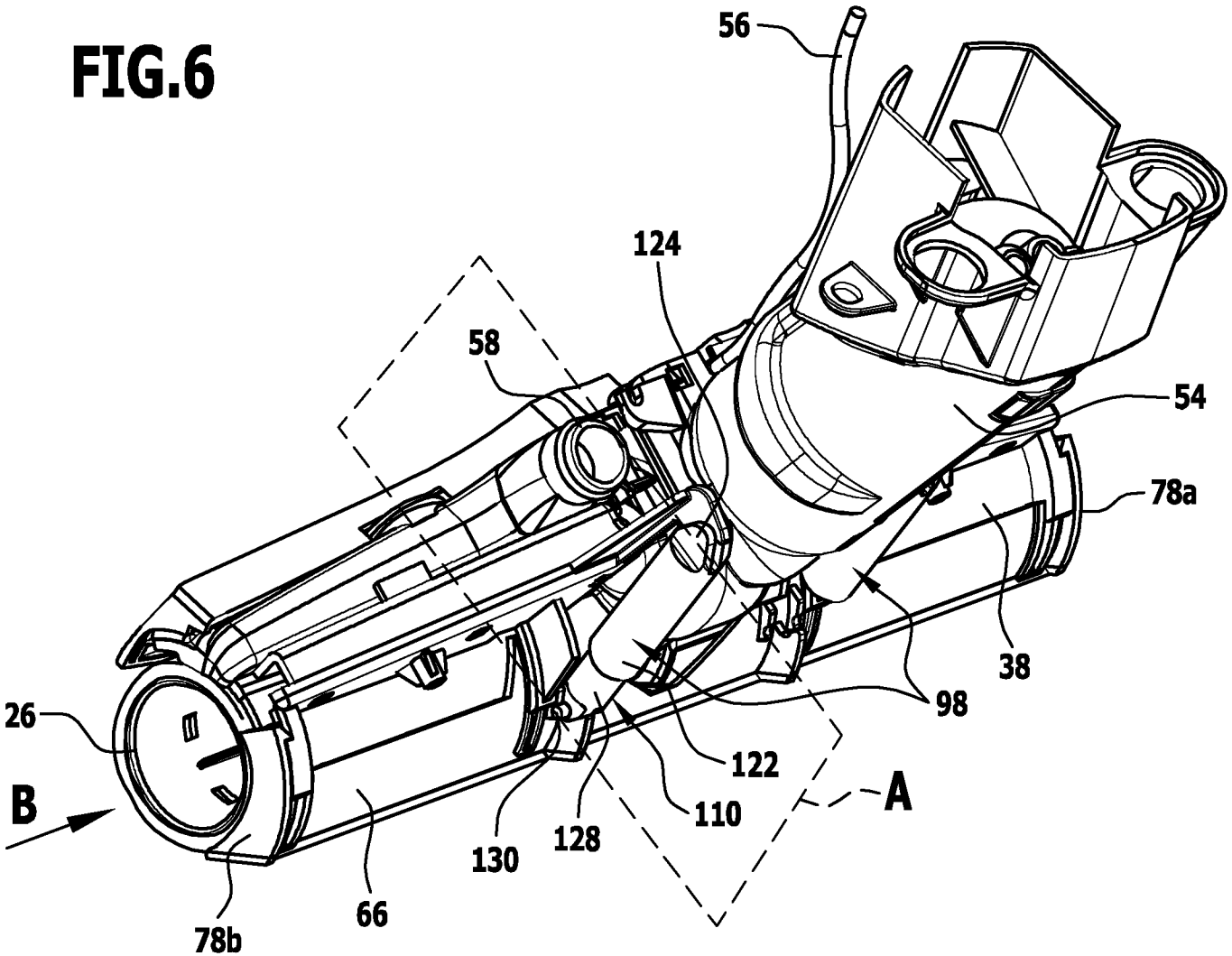
FIG. 6 shows a further perspective illustration of the roller region in FIG. 2.
Figure 7:
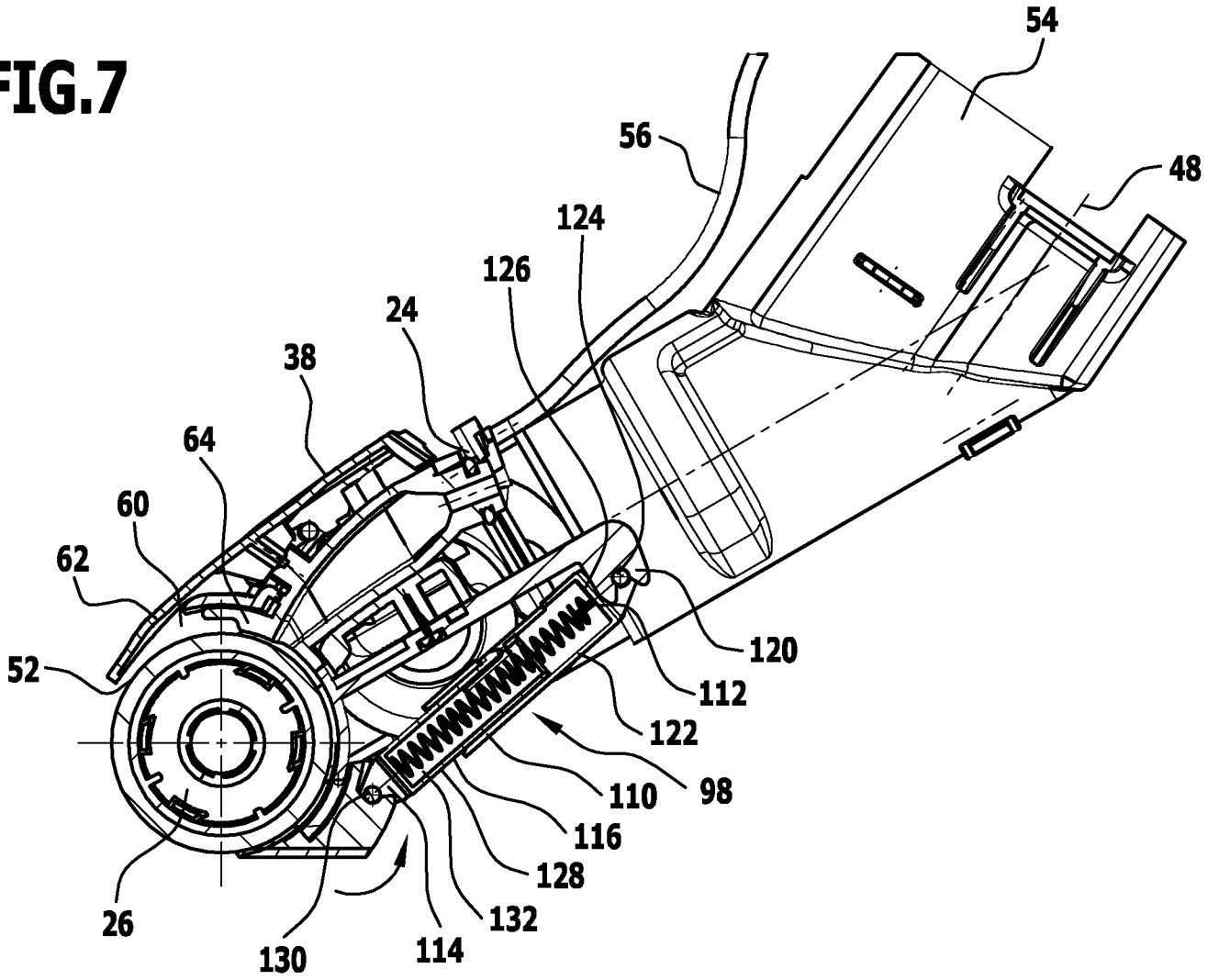
FIG. 7 shows a sectional view along the plane of section A in FIG. 6.

In addition, the sweeping element 66 is supported by way of a resilient device 98 on the cleaning roller holder 38 (FIGS. 5 to 7). The resilient device 98 provides a spring force 100 that tends to press the sweeping element 66, with the region 96 for abutment, onto the surface 46 to be cleaned. This spring force 100 causes the sweeping element 66 to rotate counterclockwise in relation to the cleaning roller holder 38. The spring force 100 tends to produce a maximum (rotational) deflection of the sweeping element 66 in relation to the cleaning roller holder 38.

This maximum rotatability is limited by an abutment. In particular, an abutment of the guide elements 78*a*, 78*b* against a corresponding abutment element of the guide track 82 limits further rotatability.

For rotation of the sweeping element 66 in relation to the cleaning roller holder 38 in a clockwise direction (indicated in FIG. 9(*a*) by the reference numeral 104), the spring force 100 of the resilient device 98 must be overcome.

The resilient device 98 in particular takes a form such that the force G of the weight of the surface cleaning machine 10 is sufficient to overcome the spring force.

Further, the resilient device takes a form such that the sweeping element 66 does not slide below the cleaning roller 26 under the action of the spring force 100 and raise it. By an appropriate dimensioning of the resilient device 98, the possibility that the cleaning roller 26 will be raised as a result of the sweeping element 66 is thus avoided.

Changing an angular position 106 of the floor surface cleaning machine 10 (in relation to a longitudinal axis 108 of this machine) then has the effect that the sweeping element 66 is automatically brought into a correct rotary position relative to the cleaning roller holder 38. As a result, an optimum sweeping result and hence cleaning result can be achieved, regardless of the angular position 106 of the floor surface cleaning machine 10.

Figure 8:
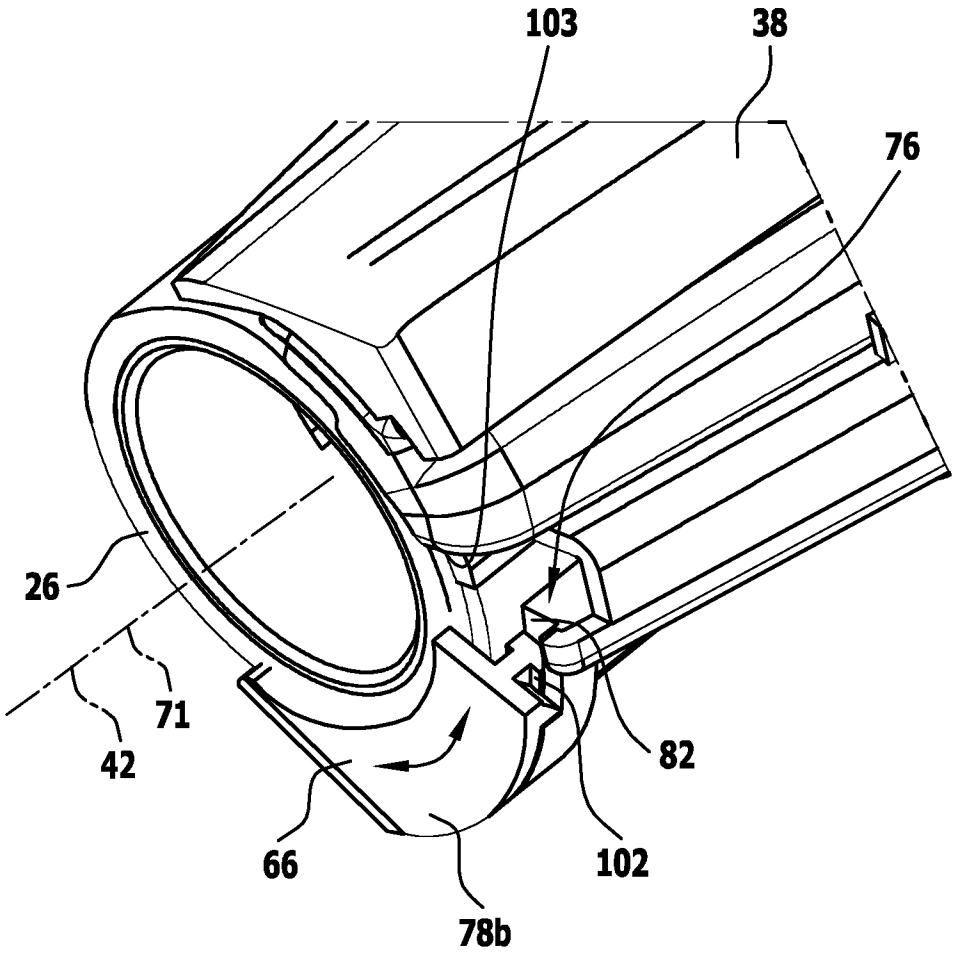
FIG. 8 shows a plan view of the roller region in the direction B in FIG. 6.

An angular range for the rotatability of the sweeping element 66 on the cleaning roller holder 38 on its circular track lies in the range of at least 20° and in particular at least 30° and in particular at least 40°. In one exemplary embodiment, this angular range is about 55°. A starting position (zero angle) is defined by minimum deflection. For this, an abutment 102 is arranged on the sweeping element 66 (FIG. 8). The cleaning roller holder 38 has a counter-element 103, and when the abutment 102 abuts against the counter-element 103 the starting position (0° position) prevails. Taking this position as a starting point, rotation in the above-mentioned angular range may then be made possible.

As already mentioned above, the actual angular position of the sweeping element 66 in relation to the cleaning roller holder 38 and hence the rotary angle in relation to the starting position then depends on the angular position 106 of the surface cleaning machine 10 in relation to the surface 46 to be cleaned.

The resilient device 98 includes a spring device 110 which is supported at one end 112 against the cleaning roller holder 38 and at an opposite end 114 against the sweeping element 66, in order that the corresponding spring force 100 for rotary driving of the sweeping element 66 can be exerted. (If the cleaning head 18 is seated immovably on the device body 12, the spring device 110 can also be supported against the device body 12 at the end 112.)

In one exemplary embodiment, the spring device 110 includes a first spring 116 and a second spring 118. The first spring 116 and the second spring 118 take the form for example of helical springs.

The first spring 116 and the second spring 118 are spaced in a direction between end sides of the sweeping element 66.

The first spring 116 and the second spring 118 are arranged such that a part of the drive device 40 is guided between them to the region 86.

The separator 90 lies between the first spring 116 and the second spring 118.

For fixing the spring device 110, a support element 120 is arranged on the cleaning roller holder 38, respectively associated with the first spring 116 and the second spring 118. A first housing part 122 is articulated to pivot on this support element 120 at a pivot bearing 124. A pivot axis of the pivot bearing 124 lies parallel to the axis of rotation 71 of the sweeping element 66.

The first housing part 122 takes for example a cylindrical form.

The corresponding spring 116 or 118 is supported by way of its end 112 against a base 126 of this first housing part 122, wherein this base 126 is closest to the pivot bearing 124.

Further, a second housing part 128 is provided. This second housing part 128 is pushed onto the first housing part 122 in the manner of a sleeve.

The second housing part 128 is articulated to pivot on the sweeping element 66 by way of a pivot bearing 130. A pivot axis of the pivot bearing 130 is parallel to the pivot axis of the pivot bearing 124 and hence parallel to the axis of rotation 71.

The second housing part 128 has a base 132 that is closest to the pivot bearing 130. The corresponding spring 116 or 118 is supported against the base 132 by way of the end 114.

The first housing part 122 and the second housing part 128 form a housing. The corresponding spring 116 or 118 is arranged protected in the interior thereof.

As a result of the pivotal articulation of the spring 116 and 118 respectively both on the cleaning roller holder 38 and on the sweeping element 66 by way of the first housing part 122 and the second housing part 128, the spring force 100 may be exerted in any rotary position of the sweeping element 66 in relation to the cleaning roller holder 38 on the corresponding circular track.

For cleaning a surface 46 to be cleaned (for example a floor surface), the surface cleaning machine 10 functions as follows:

The surface cleaning machine 10 is placed on the surface 46 to be cleaned by the cleaning roller 26, with a load-bearing line 47. A person operating the surface cleaning machine 10 holds it for example with one hand, by the handle 34. In so doing, the person adjusts an angular position 106 between the surface cleaning machine 10 and the surface 46 to be cleaned. This angular position 106 can be varied (compare FIG. 9(*b*)) in order for example to carry out cleaning under an item of furniture.

By actuating a switch, the surface cleaning machine 10 is set in operation. Here, rotation of the cleaning roller 26 about the axis of rotation 42 is actuated. This is driven by the drive device 40. Further, the suction unit 16 is actuated, and this generates a suction stream that is applied to the cleaning roller 26 at the suction nozzle 60. Further, the cleaning roller 26 is wetted by the wetting device 24.

If for example the surface cleaning machine 10 is pushed forwards, in the forward direction 68 (FIG. 1), then the cleaning roller 26 preferably rotates in a clockwise direction 70.

The moist cleaning roller 26 applies moisture to the surface 46 to be cleaned, and this detaches dirt. The rotation of the cleaning roller 26 on the surface 46 to be cleaned causes dirt to be carried along by the cleaning roller 26. Removal by suction is performed at the suction nozzle 60.

The sweeping element 66 serves to collect coarse dirt that has not (initially) been carried along by the cleaning roller 26 and to supply it to the cleaning roller 26. This coarse dirt can then be carried along by the cleaning roller 26 and removed by suction. The sweeping element 66 abuts against the surface 46 to be cleaned by means of the sweeping edge 67, over a load-bearing line 69.

The region 96 for abutment abuts against the surface 46 to be cleaned and ensures that material is carried along appropriately.

According to the invention, the sweeping element 66 is held rotationally movably on the cleaning roller holder 38. The sweeping element 66 is spring-loaded by the resilient device 98.

This automatically ensures that the sweeping element 66 abuts with the region 96 for abutment against the surface 46 to be cleaned in all angular positions 106 of the surface cleaning machine 10 in relation to the surface 46 to be cleaned. The spring force 100 of the resilient device 98 presses this region 96 for abutment with the sweeping edge 67 against the surface 46 to be cleaned.

If the angle 106 is made smaller (compare FIG. 9(*b*)), then, as a result of the rotational movability of the sweeping element 66, the latter can be entrained. When the spring force 100 is overcome, there is a movement in a clockwise direction 104. In particular, the force G of the weight of the surface cleaning machine 10 is sufficient to overcome the spring force 100 accordingly. Where appropriate, a (slight) pressure by the person operating the machine can provide for the movement.

A spacing D between the load-bearing lines 69 and 47 (taking the form of a spacing between the points of contact of the sweeping element 66 and the cleaning roller 26 on the surface 46 to be cleaned) is minimized, regardless of the angle 106.

This produces a substantially constant spacing (gap) between the rotating cleaning roller 26 and the sweeping element 66, and in particular between the region 96 for abutment, where there is abutment against the surface 46 to be cleaned, and a load-bearing region of the cleaning roller 26 on the surface 46 to be cleaned. There is no skewing. The sweeping element 66, with a sweeping edge, provides for sweeping up coarse dirt, and guiding away by way of the cleaning roller 26 is ensured at any angular position 106.

The variability of the angular position 106 has the effect of ensuring a constant spacing, because of the rotational movability of the sweeping element 66 on the cleaning roller holder 38. A region between the sweeping element 66 and the cleaning roller 26 forms a suction duct 134 that is fluidically connected to the suction nozzle 60. As a result of the rotational movability of the sweeping element 66, the length of an arc between the surface 46 to be cleaned and a projection of a nozzle of the duct 132 onto the surface 46 to be cleaned is bridged in a variable manner, and the corresponding spacing is kept substantially the same, regardless of the angular position 126.

Regardless of the angular position 106 of the surface cleaning machine 10, coarse dirt that accumulates at the sweeping element 66 can be swept up and guided away with the aid of the cleaning roller 26.

By means of its spring force 100, the resilient device 98 restores the sweeping element 66 if for example the angle for an angular position 106 is made larger (change-over from the position in FIG. 9(*b*) to the position in FIG. 9(*a*)).

As already mentioned above, in principle the sliding region 94 of the sweeping element 66 may have a rigid construction. In the case of a flexible construction, buckling away from the cleaning roller 26 may be allowed. In a corresponding buckling region, it is then possible to accumulate coarse dirt in particular during lowering (as the angle for the angular position 106 is made smaller). When the surface cleaning machine 10 is raised (as the angle for the angular position 106 is made larger), this accumulated coarse dirt can then be transported away.

Figure 10:
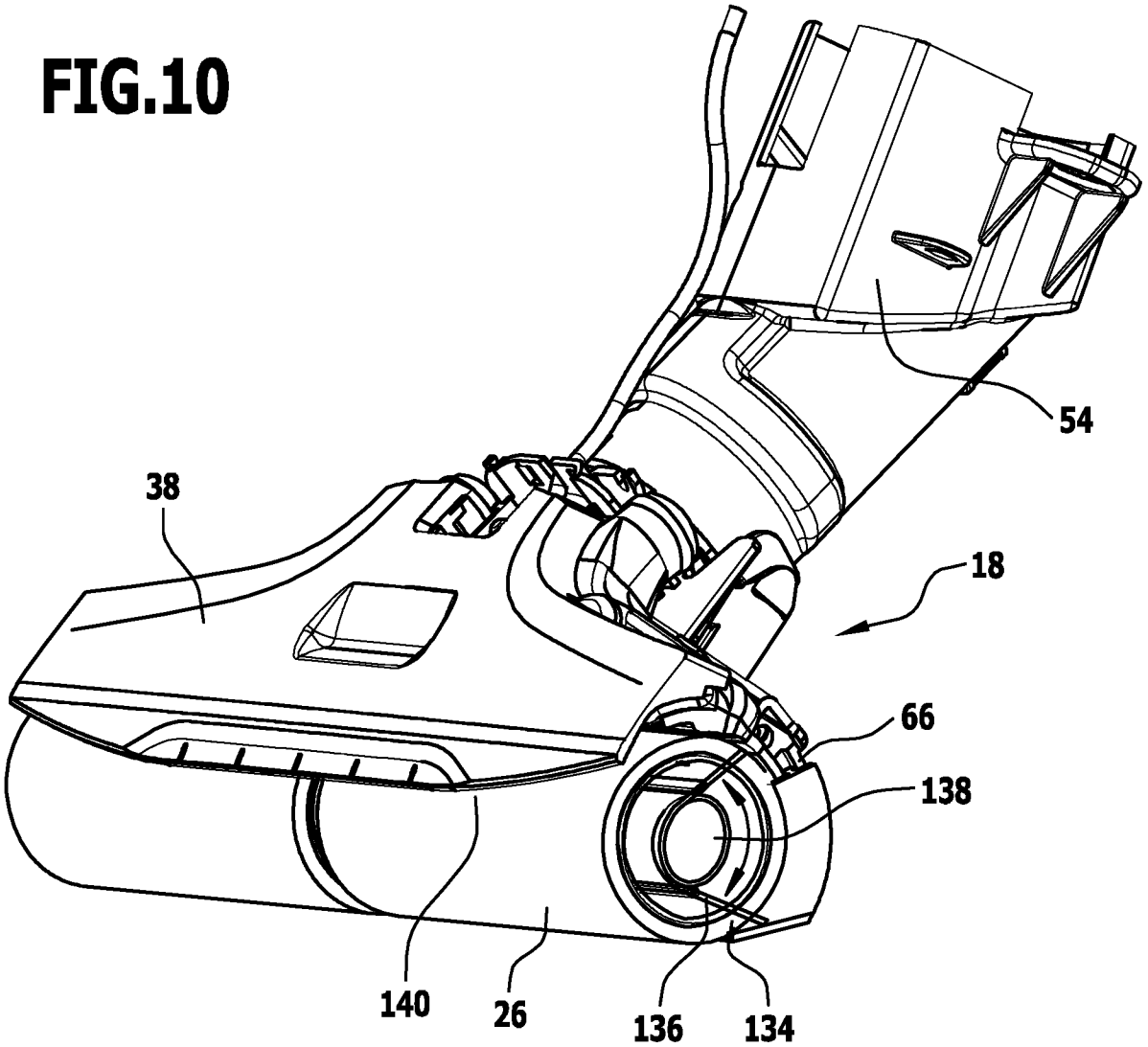
FIG. 10 shows a perspective illustration of the roller region of a further exemplary embodiment of a surface cleaning machine.

In an alternative embodiment which is shown schematically in FIG. 10, the cleaning head is in principle of the same construction as that described above. For like elements, like reference numerals are used. This exemplary embodiment differs in the construction of the resilient device. In this case, a resilient device 134 is provided. The resilient device 134 includes torsion springs 136 that are arranged on each end side of the corresponding sweeping element 66. A torsion spring 136 is in this case supported against the sweeping element 66. Further, a torsion spring 136 is supported against an element 138 that is part of the cleaning roller holder 38 or is fixedly connected thereto. This element 138 is arranged in an interior 140 of the cleaning roller holder 38. The cleaning roller 26 is also located in this interior 140.

The element 138 is for example a rod that lies coaxially with the cleaning roller 26 and lies for example in an interior of the cleaning roller 36. Here, the cleaning roller 36 in particular takes the form of a hollow roller.

Figure 11:
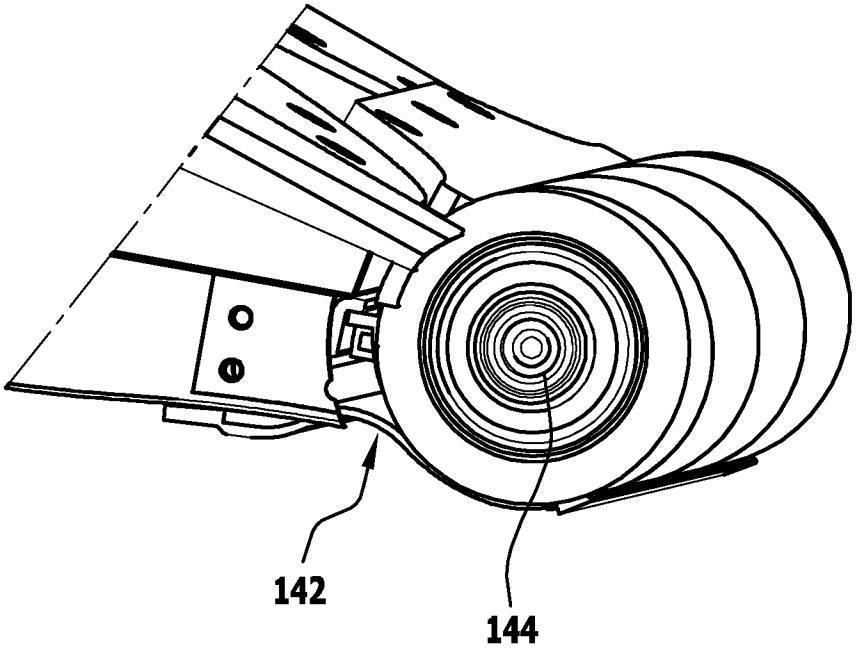
FIG. 11 shows a partial illustration of the roller region of a further exemplary embodiment of a surface cleaning machine according to the invention.

In a further exemplary embodiment (FIG. 11), a resilient device 142 is provided that has a rubber spring 144 for generating the spring force 100. This rubber spring 144 is in turn supported against the cleaning roller holder 38 and the sweeping element 66.

LIST OF REFERENCE NUMERALS

10 Surface cleaning machine
12 Device body
14 Housing
16 Suction unit
18 Cleaning head
20 Separating device
22 Reservoir device
24 Wetting device
26 Cleaning roller
28 Reservoir device
30 Holder
32 Holding rod
34 Handle
36 Winding device
38 Cleaning roller holder
40 Drive device
42 Axis of rotation
44 Pivot axis
46 Surface to be cleaned
47 Load-bearing line
44 Pivot axis
50 Longitudinal axis
52 Jacket
54 Connection piece
56 Line

58 Connector
60 Suction nozzle
62 First nozzle wall
64 Second nozzle wall
66 Sweeping element
67 Sweeping edge
68 Forward direction
69 Load-bearing line
70 Clockwise direction
71 Axis of rotation
72 First guide device
74 Inside
76 Second guide device
78*a, b* Guide element
80 Insertion region
82 Guide track
84 Transmission
86 Region
88*a, b* End side
90 Separator
92 Sliding surface
94 Sliding region
96 Region for abutment
98 Resilient device
100 Spring force
102 Abutment
103 Counter-element
104 Clockwise direction
106 Angular position
108 Longitudinal axis
110 Spring device
112 End
114 End
116 First spring
118 Second spring
120 Support element
122 First housing part
124 Pivot bearing
126 Base
128 Second housing part
130 Pivot bearing
132 Duct
134 Resilient device
136 Torsion spring
138 Element
140 Interior
142 Resilient device
144 Rubber spring

The invention claimed is:

1. A surface cleaning machine, comprising:

a cleaning roller holder;

a cleaning roller that is arranged on the cleaning roller holder;

a drive device for rotary driving of the cleaning roller; and a sweeping element that is associated with the cleaning roller and supplies swept material to the cleaning roller;

wherein the sweeping element is arranged rotatably on the cleaning roller holder;

wherein, in a cleaning mode, the surface cleaning machine is placed or supported on a surface to be cleaned solely by way of the cleaning roller;

wherein the sweeping element is arranged to be movably rotatable on the cleaning roller holder such that, in any angular position relative to the surface to be cleaned within an operating range of the surface cleaning machine, a spacing between the sweeping element and the cleaning roller is at least proximately constant.

2. The surface cleaning machine according to claim 1, wherein an axis of rotation of the sweeping element is oriented at least approximately parallel to, and in particular coaxial with, an axis of rotation of the cleaning roller.

3. The surface cleaning machine according to claim 1, comprising a resilient device that acts with a spring force on the sweeping element, wherein the spring force presses the sweeping element against a surface to be cleaned when the cleaning roller is placed on the surface to be cleaned.

4. The surface cleaning machine according to claim 3, wherein the resilient device is dimensioned such that the sweeping element is rotatably movable in opposition to the spring force as a result of the force of the weight of the surface cleaning machine.

5. The surface cleaning machine according to claim 3, wherein the resilient device is dimensioned such that the sweeping element is not pushed under the at least one cleaning roller by the action of the spring force.

6. The surface cleaning machine according to claim 3, wherein the resilient device is supported on the sweeping element and on the cleaning roller holder, or a device connected to the cleaning roller holder, and is in particular articulated thereto.

7. The surface cleaning machine according to claim 3, wherein the resilient device has at least one helical spring or torsion spring or rubber spring or pneumatic spring.

8. The surface cleaning machine according to claim 3, wherein the resilient device includes at least a first spring and a second spring which are spaced from one another, and wherein the drive device is at least partly located between the first spring and the second spring.

9. The surface cleaning machine according to claim 3, wherein a direction of rotation of the sweeping element in opposition to the spring force is clockwise, and in particular a direction of rotation of the sweeping element when it is moved by the spring force is counterclockwise.

10. The surface cleaning machine according to claim 1, comprising a suction device having a suction unit and at least one suction nozzle which is fluidically connected to the suction unit and is directed towards the cleaning roller for the removal of fluid at the cleaning roller by suction.

11. The surface cleaning machine according to claim 10, wherein, in a cleaning mode, the sweeping element is located between a surface to be cleaned, towards which the cleaning roller is directed, and the at least one suction nozzle.

12. The surface cleaning machine according to claim 1, wherein a spacing between the sweeping element and a contact region of the cleaning roller on the surface to be cleaned is at least approximately constant.

13. The surface cleaning machine according to claim 1, wherein, in a cleaning mode with the surface cleaning machine being pushed forwards, a direction of rotation of the cleaning roller is clockwise.

14. A surface cleaning machine according to claim 1, wherein an angular range for the rotatability of the sweeping element on the cleaning roller holder comprises at least 20° in relation to a starting position, wherein in the starting position the sweeping element is deflected to a minimal extent in relation to the cleaning roller holder.

15. The surface cleaning machine according to claim 1, wherein the sweeping element has a sliding region for sliding on the cleaning roller holder.

16. The surface cleaning machine according to claim 15, wherein the sliding region takes the form of a cylinder shell or part of a cylinder shell.

17. The surface cleaning machine according to claim 15, wherein the cleaning roller holder has an inside that faces the cleaning roller and on which the sliding region of the sweeping element is slidable.

18. The surface cleaning machine according to claim 15, wherein the sliding region has a rigid construction.

19. The surface cleaning machine according to claim 15, wherein the sliding region is of a sufficiently flexible construction for it to be bucklable away from the cleaning roller as a result of accumulations of dirt.

20. The surface cleaning machine according to claim 1, wherein the sweeping element has a region for abutment against a surface to be cleaned that is arranged in particular on a sliding region of the sweeping element.

21. The surface cleaning machine according to claim 1, wherein there is arranged on the cleaning roller holder a first guide device and on the sweeping element a second guide device that cooperates with the first guide device for the purpose of rotatable guidance of the sweeping element on the cleaning roller holder.

22. The surface cleaning machine according to claim 21, wherein the second guide device has guide elements that are arranged on end sides of the sweeping element and cooperate with counter-guiding elements of the first guide device that are arranged on end sides of the cleaning roller holder, and wherein at least one of the first guide device and the second guide device provides a guide track.

23. The surface cleaning machine according to claim 1, wherein the sweeping element is guided on a circular track on the cleaning roller holder.

24. The surface cleaning machine according to claim 1, wherein when the surface cleaning machine having a cleaning roller placed on a surface to be cleaned is pushed in a forward direction, the sweeping element, remote from the forward direction, covers the cleaning roller to the rear and lies on the surface to be cleaned at least over a length of the cleaning roller.

25. The surface cleaning machine according to claim 1, comprising a wetting device for the cleaning roller.

26. A surface cleaning machine, comprising:
a cleaning roller holder;
a cleaning roller that is arranged on the cleaning roller holder;
a drive device for rotary driving of the cleaning roller; and
a sweeping element that is associated with the cleaning roller and supplies swept material to the cleaning roller;
wherein the sweeping element is arranged rotatably on the cleaning roller holder, and
wherein an axis of rotation of the sweeping element is oriented at least approximately parallel to an axis of rotation of the cleaning roller.

27. A surface cleaning machine, comprising:
a cleaning roller holder;
a cleaning roller that is arranged on the cleaning roller holder;
a drive device for rotary driving of the cleaning roller;
a sweeping element that is associated with the cleaning roller and supplies swept material to the cleaning roller; and
a resilient device that acts with a spring force on the sweeping element, wherein the spring force presses the sweeping element against a surface to be cleaned when the cleaning roller is placed on the surface to be cleaned,
wherein the sweeping element is arranged rotatably on the cleaning roller holder, and
wherein the resilient device includes at least a first spring and a second spring which are spaced from one another, and wherein the drive device is at least partly located between the first spring and the second spring.

28. A surface cleaning machine, comprising:
a cleaning roller holder;
a cleaning roller that is arranged on the cleaning roller holder;
a drive device for rotary driving of the cleaning roller; and
a sweeping element that is associated with the cleaning roller and supplies swept material to the cleaning roller;
wherein the sweeping element is arranged rotatably on the cleaning roller holder, and
wherein an angular range for the rotatability of the sweeping element on the cleaning roller holder comprises at least 20° in relation to a starting position, wherein in the starting position the sweeping element is deflected to a minimal extent in relation to the cleaning roller holder.

29. A surface cleaning machine, comprising:
a cleaning roller holder;
a cleaning roller that is arranged on the cleaning roller holder;
a drive device for rotary driving of the cleaning roller; and
a sweeping element that is associated with the cleaning roller and supplies swept material to the cleaning roller;
wherein the sweeping element is arranged rotatably on the cleaning roller holder, and
wherein the sweeping element has a sliding region for sliding on the cleaning roller holder.

30. A surface cleaning machine, comprising:
a cleaning roller holder;
a cleaning roller that is arranged on the cleaning roller holder;
a drive device for rotary driving of the cleaning roller; and
a sweeping element that is associated with the cleaning roller and supplies swept material to the cleaning roller;
wherein the sweeping element is arranged rotatably on the cleaning roller holder, and
wherein the sweeping element has a region for abutment against a surface to be cleaned that is arranged in particular on a sliding region of the sweeping element.

31. A surface cleaning machine, comprising:
a cleaning roller holder;
a cleaning roller that is arranged on the cleaning roller holder;
a drive device for rotary driving of the cleaning roller; and
a sweeping element that is associated with the cleaning roller and supplies swept material to the cleaning roller;
wherein the sweeping element is arranged rotatably on the cleaning roller holder, and
wherein there is arranged on the cleaning roller holder a first guide device and on the sweeping element a second guide device that cooperates with the first guide device for the purpose of rotatable guidance of the sweeping element on the cleaning roller holder.

32. A surface cleaning machine, comprising:
a cleaning roller holder;
a cleaning roller that is arranged on the cleaning roller holder;
a drive device for rotary driving of the cleaning roller; and
a sweeping element that is associated with the cleaning roller and supplies swept material to the cleaning roller;
wherein the sweeping element is arranged rotatably on the cleaning roller holder, and wherein the sweeping element is guided on a circular track on the cleaning roller holder.

* * * * *